US010347174B2

(12) United States Patent
Ng et al.

(10) Patent No.: US 10,347,174 B2
(45) Date of Patent: Jul. 9, 2019

(54) SYSTEM OF COMPRESSED FRAME SCANNING FOR A DISPLAY AND A METHOD THEREOF

(71) Applicant: Solomon Systech Limited, Hong Kong (HK)

(72) Inventors: Wai Hon Ng, Hong Kong (HK); Chi Wai Lee, Hong Kong (HK); Wing Chi Stephen Chan, Hong Kong (HK); Ling Sum Leung, Hong Kong (HK)

(73) Assignee: Solomon Systech Limited, Hong Kong (HK)

( * ) Notice: Subject to any disclaimer, the term of this patent is extended or adjusted under 35 U.S.C. 154(b) by 0 days.

(21) Appl. No.: 15/803,872

(22) Filed: Nov. 6, 2017

(65) Prior Publication Data

US 2018/0190188 A1 Jul. 5, 2018

Related U.S. Application Data

(60) Provisional application No. 62/441,940, filed on Jan. 3, 2017.

(51) Int. Cl.

| | |
|---|---|
| ***G09G 3/32*** | (2016.01) |
| ***G09G 5/10*** | (2006.01) |
| ***G09G 3/3216*** | (2016.01) |

(52) U.S. Cl.

CPC ..... *G09G 3/3216* (2013.01); *G09G 5/10* (2013.01); *G09G 2310/0213* (2013.01); (Continued)

(58) Field of Classification Search

CPC ..... G09G 3/3622–3644; G09G 3/3681; G09G 3/3692; G09G 3/3216; G09G 5/10; (Continued)

(56) References Cited

U.S. PATENT DOCUMENTS 6,646,654 B2 * 11/2003 Takagi ..... G09G 3/2085 345/690
8,456,098 B2 * 6/2013 Peting ..... H05B 37/0245 315/227 R (Continued)

FOREIGN PATENT DOCUMENTS

| | | | |
|---|---|---|---|
| CN | 1601587 | A | 3/2005 |
| CN | 101136172 | A | 3/2008 |
| CN | 101681593 | A | 3/2010 |

*Primary Examiner* — Stephen G Sherman

(57) ABSTRACT

A system enabling compressed frame scanning for a display and a method thereof are described herein. A pixel having a maximum pixel data in a row of the plurality of rows corresponding to a frame is identified. The maximum pixel data identified in the row is assigned as a pixel data for the row. A scan time for the row is computed based upon the pixel data of the row and a scanning time associated with a unit of the brightness index. An aggregate scan time for the frame is determined based upon the scan time computed for each of the plurality of rows corresponding to the frame. Finally, the frame is scanned based upon the aggregate scan time determined for the frame thereby enabling compressed scanning of the frame. The method is further implemented for randomly assigned rows of the frame to two or more sub-frames of the frame.

20 Claims, 17 Drawing Sheets

(52) U.S. Cl.
CPC ..... *G09G 2310/0218* (2013.01); *G09G 2310/0224* (2013.01); *G09G 2320/0233* (2013.01); *G09G 2320/0247* (2013.01); *G09G 2320/0252* (2013.01); *G09G 2360/12* (2013.01); *G09G 2360/16* (2013.01)

(58) Field of Classification Search
CPC ... G09G 2310/0224; G09G 2320/0233; G09G 2320/0247; G09G 2320/0252; G09G 2310/0213; G09G 2310/0218; G09G 2360/12; G09G 2360/16
See application file for complete search history.

(56) References Cited

U.S. PATENT DOCUMENTS

2006/0152437 A1* 7/2006 Ogawa ..... G09G 3/004 345/35
2007/0085779 A1* 4/2007 Smith ..... G09G 3/3216 345/76
2008/0272989 A1* 11/2008 Takahashi ..... G09G 3/3216 345/76
2008/0309592 A1* 12/2008 Ohashi ..... G09G 3/22 345/75.2
2009/0219268 A1* 9/2009 Sagano ..... G09G 3/2014 345/208

* cited by examiner

SYSTEM OF COMPRESSED FRAME SCANNING FOR A DISPLAY AND A METHOD THEREOF

CROSS-REFERENCE TO RELATED APPLICATIONS AND PRIORITY

The present application claims priority from U.S. Provisional Patent Application No. 62/441,940 dated Jan. 3, 2017, the entirety of which is incorporated herein by a reference.

TECHNICAL FIELD

The present application, in general, relates to a system and method for enabling compressed frame scanning for a display.

BACKGROUND

Various display devices such are LED, LEC, plasma, Passive Matrix Organic Light Emitting Diode (PMOLED), Active Matrix Organic Light Emitting Diode (AMOLED), and the like have been proposed and are being used. The Passive Matrix Organic Light Emitting Diode (PMOLED) display has a 3-layer basic structure. In the PMOLED display panel, an electroluminescent layer is sandwiched between two layers of parallel strip-shaped electrodes. The two layers of electrodes are arranged in a grid of row and column electrodes. In the PMOLED panel, the intersection points of the lower and upper layers of electrodes are the pixels (also referred as OLED pixels). The OLED pixels may be addressed and activated by passing a current through selection of row and column electrodes. One layer of electrodes is referred to as a source layer which provides electric current to the OLED material. The other layer of electrodes is referred to as a common layer which collects the electric current from the OLED material.

All of the pixels have different brightness index. The brightness index is a numerical value falling within a range 0-100, wherein the brightness index with numerical value '100' indicates full brightness and the brightness index with numerical value '0' indicates full darkness. In the conventional method of driving the PMOLED display involves scan each horizontal row in succession. In this conventional method, all the source drivers drive the display panel concurrently while only one common electrode switch is selected at a time. The common electrode selected is shorted to ground while the others are disconnected from ground. This process is repeated row after row until all the rows are scanned. The PMOLED display has a certain refresh rate which is further dependent upon the number of rows to be scanned. In an example, consider the PMOLED display is operating at 100 Hz (i.e. refresh rate of the PMOLED display is 100 Hz), then each frame scan should be completed within the time period of 10 ms. In such a scenario, maximum 100 rows can be scanned by the aforementioned conventional method of driving the display panel. Further, if the number of rows is extended to 150 rows, then the aggregate scan time for a frame increases beyond 10 ms. Hence, the display cannot maintain the original 100 Hz refresh rate. More specifically, the display operates at a slower refresh rate. The slower refresh rate, in turn, affects the overall brightness of the display. The display not only has a lower overall brightness but also result in suffering from visual flickering.

SUMMARY

Before the present systems and methods along with components related thereto are described, it is to be understood that this application is not limited to the particular methods and systems and their arrangement as described, as there can be multiple possible embodiments which are not expressly illustrated in the present application but may still be practicable within the scope of the invention. It is also to be understood that the terminology used in the description is for the purpose of describing the particular versions or embodiments only, and is not intended to limit the scope of the present application. This summary is provided to introduce concepts related to system of compressed frame scanning for a display and a method thereof and the concepts are further described below in the detailed description. This summary is not intended to identify essential features of the claimed subject matter nor is it intended for use in determining or limiting the scope of the claimed subject matter.

In one embodiment, a system enabling compressed frame scanning for a display is described herein. The system may include a display panel comprising a plurality of common electrodes and a plurality of source electrodes arranged in form of a plurality of rows and a plurality of columns, respectively, corresponding to a frame, wherein an intersection of a row and a column, in the display panel, represents a pixel of a plurality of pixels associated to the display panel, and wherein each pixel is assigned with a predefined pixel data indicating a brightness index associated with each pixel. The system may further include a max finder adapted to identify a pixel having a maximum pixel data in a row of the plurality of rows corresponding to the frame. The system may further include a scan control logic adapted to scan each of the plurality of rows corresponding to the frame, wherein the scanning may comprise assigning the maximum pixel data identified in the row as a pixel data for the row. The scanning, via the scan control logic, may further include computing a scan time for the row based upon the pixel data of the row and a scanning time associated with a unit of the brightness index. Further, the scanning, via the scan control logic, may further include determining an aggregate scan time for the frame based upon the scan time computed for each of the plurality of rows corresponding to the frame. The scanning, via the scan control logic, may further include scanning the frame based upon the aggregate scan time determined for the frame thereby enabling compressed scanning of the frame.

In another embodiment, a method of compressed frame scanning for a display is described herein. The method may include providing a display panel comprising a plurality of common electrodes and a plurality of source electrodes arranged in form of a plurality of rows and a plurality of columns, respectively, corresponding to a frame, wherein an intersection of a row and a column, in the display panel, represents a pixel of a plurality of pixels associated to the display panel, and wherein each pixel is assigned with a predefined pixel data indicating a brightness index associated with each pixel. The method may further include identifying, via a max finder, a pixel having a maximum pixel data in a row of the plurality of rows corresponding to the frame. The method may further include assigning, via the scan control logic, the maximum pixel data identified in the row as a pixel data for the row. The method may further include computing, via the scan control logic, a scan time for the row based upon the pixel data of the row and a scanning time associated with a unit of the brightness index. Further, the method may include determining, via the scan control logic, an aggregate scan time for the frame based upon the scan time computed for each of the plurality of rows corresponding to the frame. The method may further include scanning, via the scan control logic, the frame based upon the aggregate scan time determined for the frame thereby enabling compressed scanning of the frame.

In yet another embodiment, a system enabling compressed frame scanning for a display is described herein. The system may include a display panel comprising a plurality of common electrodes and a plurality of source electrodes arranged in form of a plurality of rows and a plurality of columns, respectively, corresponding to a frame, wherein an intersection of a row and a column, in the display panel, represents a pixel of a plurality of pixels associated to the display panel, and wherein each pixel is assigned with a predefined pixel data indicating a brightness index associated with each pixel. The system may further include a frame analyzing module adapted to divide the frame into a first sub-frame and a second sub-frame and randomly assign a first set of rows of the plurality of rows and a second set of rows to the first sub-frame and the second sub-frame respectively. The system may further include a max finder adapted to identify a pixel having a maximum pixel data in a row of the first set of rows and a row of the second set of rows. The system may further include a scan control logic adapted to scan each of the plurality of rows corresponding to the frame. The scanning, via the scan control logic, may include assigning the maximum pixel data identified in the row of the first set of rows and the row of the second set of rows as a pixel data for the row of the first set of rows and the row of the second set of rows respectively. The scanning, via the scan control logic, may further include computing a scan time for the row of the first set of rows based upon the pixel data of the row of the first set of rows and a scanning time associated with a unit of the brightness index. The scanning, via the scan control logic, may further include computing a scan time for the row of the second set of rows based upon the pixel data of the row of the second set of rows and the scanning time associated with a unit of the brightness index. The scanning, via the scan control logic, may further include determining an aggregate scan time for the first sub-frame and the second sub-frame based upon the scan time computed for each row of the first set of rows and each row of the second set of rows respectively. The scanning, via the scan control logic, may further include scanning the frame based upon the aggregate scan time determined for the first sub-frame and the second sub-frame thereby enabling compressed scanning of the frame.

In still another embodiment, a method enabling compressed frame scanning for a display is described herein. The method may include providing a display panel comprising a plurality of common electrodes and a plurality of source electrodes arranged in form of a plurality of rows and a plurality of columns, respectively, corresponding to a frame, wherein an intersection of a row and a column, in the display panel, represents a pixel of a plurality of pixels associated to the display panel, and wherein each pixel is assigned with a predefined pixel data indicating a brightness index associated with each pixel. The method may further include dividing, via a frame analyzing module, the frame into a first sub-frame and a second sub-frame. The method may further include randomly assigning, via the frame analyzing module, a first set of rows of the plurality of rows and a second set of rows to the first sub-frame and the second sub-frame respectively. The method may further include identifying, via the max finder, a pixel having a maximum pixel data in a row of the first set of rows and a row of the second set of rows. The method may further include assigning, via a scan control logic, the maximum pixel data identified in the row of the first set of rows and the row of the second set of rows as a pixel data for the row of the first set of rows and the row of the second set of rows respectively. The method may further include computing, via the scan control logic, a scan time for the row of the first set of rows based upon the pixel data of the row of the first set of rows and a scanning time associated with a unit of the brightness index. The method may further include computing, via the scan control logic, a scan time for the row of the second set of rows based upon the pixel data of the row of the second set of rows and the scanning time associated with a unit of the brightness index. The method may further include determining, via the scan control logic, an aggregate scan time for the first sub-frame and the second sub-frame based upon the scan time computed for each row of the first set of rows and each row of the second set of rows respectively. The method may further include scanning, via the scan control logic, the frame based upon the aggregate scan time determined for the first sub-frame and the second sub-frame thereby enabling compressed scanning of the frame.

BRIEF DESCRIPTION OF THE FIGURES

The detailed description is described with reference to the accompanying Figures. In the Figures, the left-most digit(s) of a reference number identifies the Figure in which the reference number first appears. The same numbers are used throughout the figures to refer like features and components.

DETAILED DESCRIPTION

Figure 1:
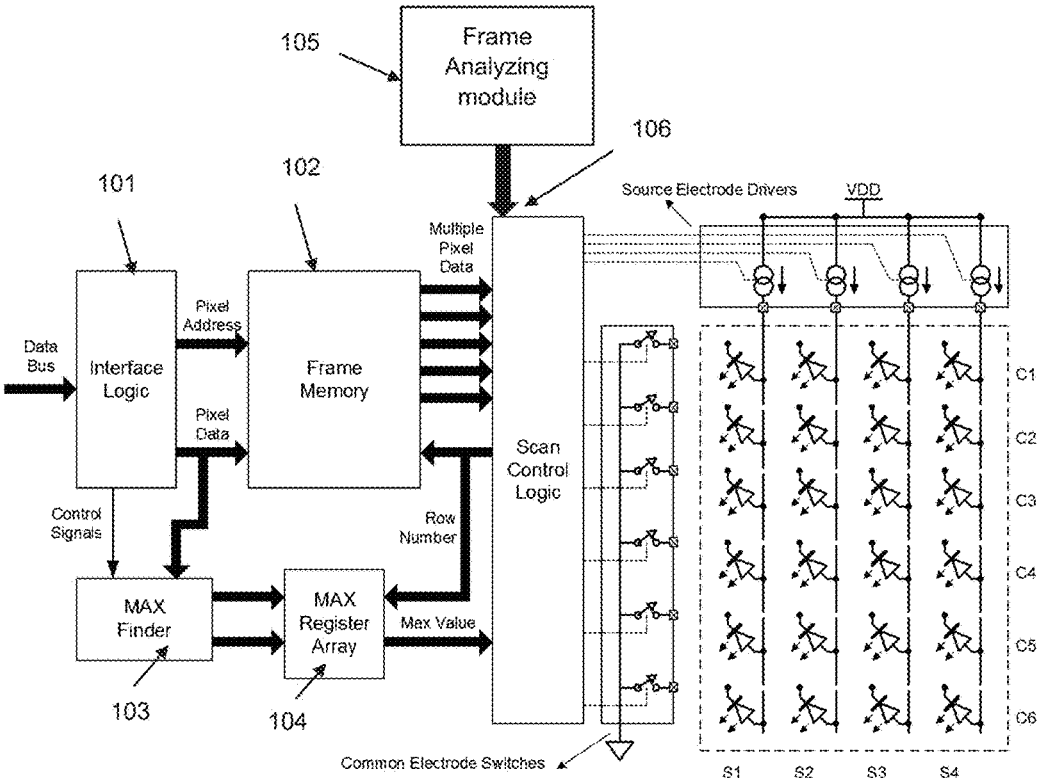
FIG. 1 illustrates a system enabling compressed frame scanning for a display, in accordance with an embodiment of the present application.

Reference throughout the specification to "various embodiments," "some embodiments," "one embodiment," or "an embodiment" means that a particular feature, structure, or characteristic described in connection with the embodiment is included in at least one embodiment. Thus, appearances of the phrases "in various embodiments," "in some embodiments," "in one embodiment," or "in an embodiment" in places throughout the specification are not necessarily all referring to the same embodiment. Furthermore, the particular features, structures or characteristics may be combined in any suitable manner in one or more embodiments.

Some embodiments of this application, illustrating all its features, will now be discussed in detail. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise. Although any system and methods similar or equivalent to those described herein can be used in the practice or testing of embodiments of the present application, the exemplary, system and methods are now described. The disclosed embodiments are merely exemplary of the application, which may be embodied in various forms.

Various modifications to the embodiments will be readily apparent to those skilled in the art and the generic principles herein may be applied to other embodiments. However, one of ordinary skill in the art will readily recognize that the present application is not intended to be limited to the embodiments illustrated, but is to be accorded the widest scope consistent with the principles and features described herein.

The present application describes system(s) and method(s) for enabling compressed frame scanning for a display. The system may include a display panel comprising a plurality of common electrodes and a plurality of source electrodes arranged in form of a plurality of rows and a plurality of columns, respectively, corresponding to a frame. In one aspect, an intersection of a row and a column, in the display panel, represents a pixel of a plurality of pixels associated to the display panel, and each pixel is assigned with a predefined pixel data indicating a brightness index associated with each pixel.

In accordance with an aspect of the present disclosure, a system and a method may enable identifying a pixel having a maximum pixel data in a row of the plurality of rows corresponding to the frame. Further, the system and method may enable assigning the maximum pixel data identified in the row as a pixel data for the row. Further, the system and method may enable computing a scan time for the row based upon the pixel data of the row and a scanning time associated with a unit of the brightness index. Further, the system and method may enable determining an aggregate scan time for the frame based upon the scan time computed for each of the plurality of rows corresponding to the frame. Furthermore, the system and method may enable scanning the frame based upon the aggregate scan time determined for the frame thereby enabling compressed scanning of the frame.

In accordance with another aspect of the present disclosure, a system and a method may enable dividing the frame into a first sub-frame and a second sub-frame. Further, the system and method may enable randomly assigning a first set of rows of the plurality of rows and a second set of rows to the first sub-frame and the second sub-frame respectively. Further, the system and method may enable identifying a pixel having a maximum pixel data in a row of the first set of rows and a row of the second set of rows. Further, the system and method may enable assigning the maximum pixel data identified in the row of the first set of rows and the row of the second set of rows as a pixel data for the row of the first set of rows and the row of the second set of rows respectively. Further, the system and method may enable computing a scan time for the row of the first set of rows based upon the pixel data of the row of the first set of rows and a scanning time associated with a unit of the brightness index. Further, the system and method may enable computing a scan time for the row of the second set of rows based upon the pixel data of the row of the second set of rows and the scanning time associated with a unit of the brightness index. Further, the system and method may enable determining an aggregate scan time for the first sub-frame and the second sub-frame based upon the scan time computed for each row of the first set of rows and each row of the second set of rows respectively. Further, the system and method may enable scanning the frame based upon the aggregate scan time determined for the first sub-frame and the second sub-frame thereby enabling compressed scanning of the frame While aspects of described system of compressed frame scanning for a display and a method thereof may be implemented in any number of different systems, environments, and/or configurations, the embodiments are described in the context of the following exemplary system.

Referring to FIG. 1 is a system enabling a compressed frame scanning for a display is illustrated, in accordance with an embodiment of the present application. As shown in FIG. 1, the system may include an interface logic 101, a frame memory 102 and modules. The modules may further comprise a max finder 103, a max register array 104, a frame analyzing module 105 and a scan control logic 106. The modules may comprise a set of processor executable programmed instructions capable of being stored in any computer-readable medium known in the art including, for example, volatile memory, such as static random access memory (SRAM) and dynamic random access memory (DRAM), and/or non-volatile memory, such as read only memory (ROM), erasable programmable ROM, flash memories, hard disks, optical disks, and memory cards. The modules may further comprise routines, programs, objects, components, data structures, etc., which perform particular tasks, functions or implement abstract data types.

Figure 2:
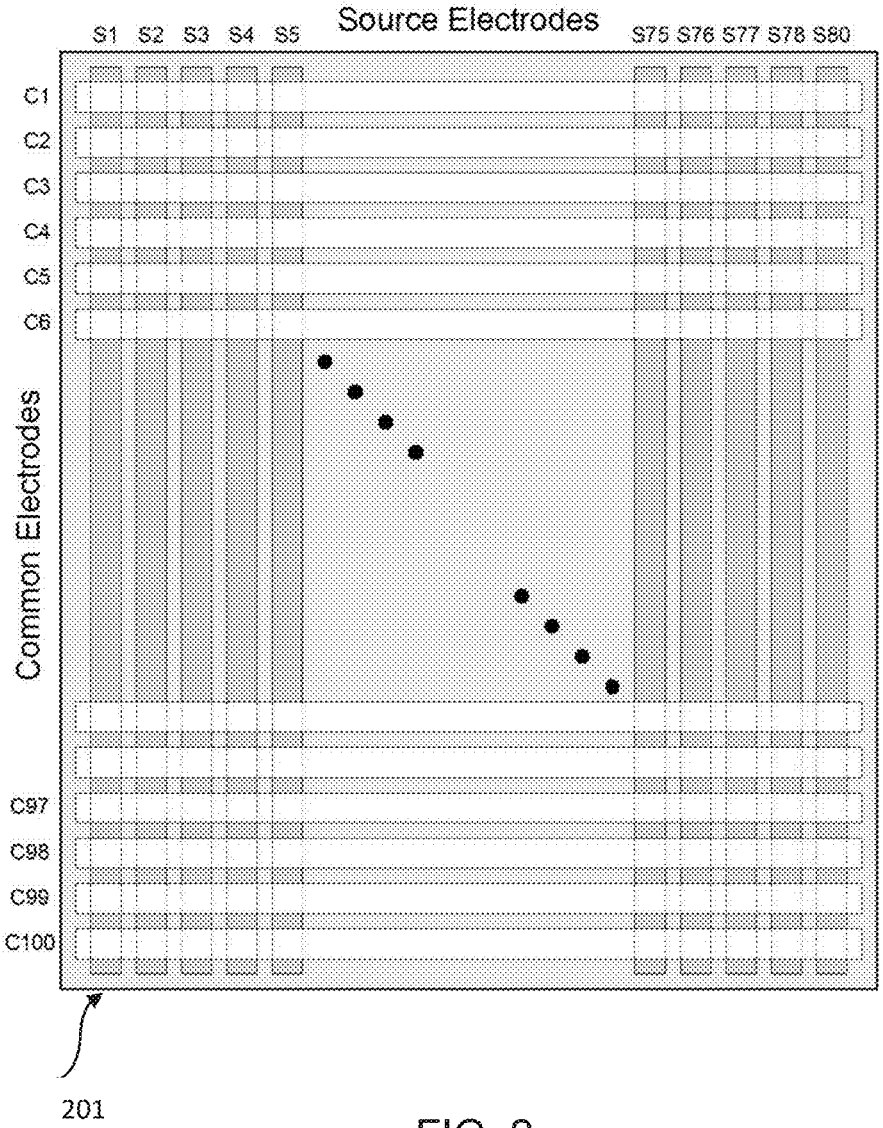
FIG. 2 illustrates a structure of a PMOLED including an electroluminescent layer sandwiched by two layers of electrode, in accordance with an embodiment of the present application.

Now referring to FIG. 2 is a structure of a PMOLED including an electroluminescent layer sandwiched by two layers of electrode is illustrated, in accordance with an embodiment of the present application. As shown the PMOLED may include a plurality of common electrodes C1, C2 . . . Cn horizontally arranged in the PMOLED and may occupy a top layer. Further, the PMOLED may include a plurality of source electrodes S1, S2 . . . Sn vertically arranged in the PMOLED and may occupy a bottom layer. More particularly, the plurality of common electrodes and the plurality of source electrodes may be in the form of a plurality of rows and a plurality of columns, respectively, that may correspond to a frame 201. The electroluminescent layer which is a semi-transparent layer may be sandwiched between the two layers of electrodes. The display panel may have multiple source electrodes and multiple common electrodes. In one embodiment, the PMOLED panel may include 80 source electrodes and 100 common electrodes as shown in FIG. 2.

Figure 3:
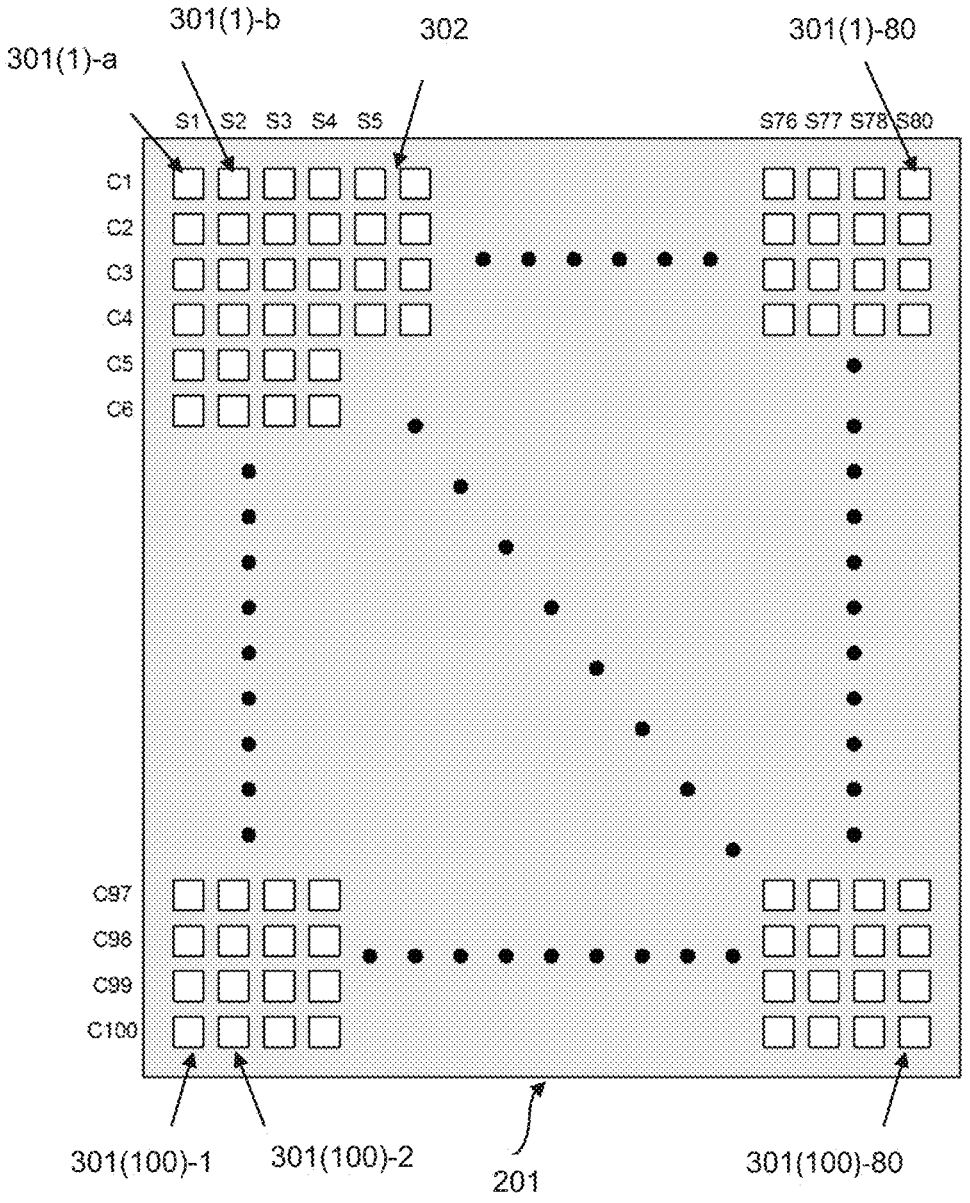
FIG. 3 illustrates a PMOLED panel having pixels arranged in an array, in accordance with an embodiment of the present application.

Now referring to FIG. 3, a PMOLED panel having pixels arranged in an array is illustrated, in accordance with an embodiment of the present application. As shown, one side of the PMOLED panel may be connected to multiple source drivers while the other side of the PMOLED panel may be connected to multiple common drivers. The common drivers may be programmable switches that bridge the common electrodes to ground. It must be understood that an intersection of a row and a column, in the display panel, may represent a pixel of a plurality of pixels 301(1)-a, 301(1)-b, 301(2)-a . . . 301(100)-80, hereinafter referred to as a pixel 301, associated to the display panel. Each pixel 301 may assigned with a predefined pixel data, wherein the pixel data may further indicate a brightness index associated with each pixel 301. The area 302 as shown is a transition period which may indicate a period when the common electrodes switch over one to another.

Now referring to FIG. 1, FIG. 2 and FIG. 3, the interface logic 101 may store the pixel data and a pixel address into the frame memory 102. The interface logic 101 may further send the pixel data to the max finder 103. Further, the max finder 103 may identify a pixel 301 having a maximum pixel data in a row of the plurality of rows corresponding to the frame. The max finder 103 may register the maximum pixel data into the max register array 104 and reset itself to zero. The frame memory 102 may send the plurality of pixel data or multiple pixel data to the scan control logic 106. The scan control logic 106 may further send the row number to the frame memory 102 and to the max register array 104. At the start of each row, the interface logic 101 may send a control signal to the max finder 103. Further, the max register array 104 may send the maximum value to the scan control logic 106. The scan control logic 106 may assign the maximum pixel data identified in the row as a pixel data for the row. Further the scan control logic 106 may compute a scan time for the row based upon the pixel data of the row and a scanning time associated with a unit of the brightness index. The scan control logic 106 may determine an aggregate scan time for the frame 201 based upon the scan time computed for each of the plurality of rows corresponding to the frame 201. Further, the scan control logic 106 may scan the frame 201 based upon the aggregate scan time determined for the frame 201 thereby enabling compressed scanning of the frame 201.

In one embodiment, the brightness index may have a value falling within a range of 0-100 having a minimum brightness index value and a maximum brightness index value of '0' and '100' respectively. In one embodiment, the minimum brightness index value and the maximum brightness index value, respectively, may indicate full darkness and full brightness in the display.

In one embodiment, the scan control logic 106 may be adapted to connect a common electrode, corresponding to the row, to a ground while disconnecting the other common electrodes corresponding to the other rows of the plurality of rows from the ground. Further, the scan control logic 106 may be adapted to enable each source electrode corresponding to the frame 201 to output a predefined constant current based upon the pixel data corresponding to each pixel 301. In one embodiment, each source electrode may be enabled to output the predefined constant current after the expiry of a transition period 302. The transition period 302 indicates a time period between the termination of the scanning a row and initiation of the scanning of a subsequent row of the plurality of rows.

In one embodiment, the scan control logic 106 may further adapted to append an idle time period after the scanning of the frame 201 and before the initiation of the scanning of a subsequent frame 201. In one embodiment, the idle period may be appended if the aggregate scan time is less than a predefined frame period.

In one embodiment, the scanning time associated with the unit of brightness index may depend upon the ratio of a standard scanning time allocated to each row to the maximum brightness index value. The standard scanning time allocated to each row may depend upon a predefined refresh rate associated with the display.

In one embodiment, the scan control logic 106 may further adapted to combine the scanning of two rows of the plurality of rows thereby enabling further compression of the scanning of the frame 201. Further, the common electrodes corresponding to the two rows are driven by increasing the current source from the corresponding source electrodes.

Figure 4:
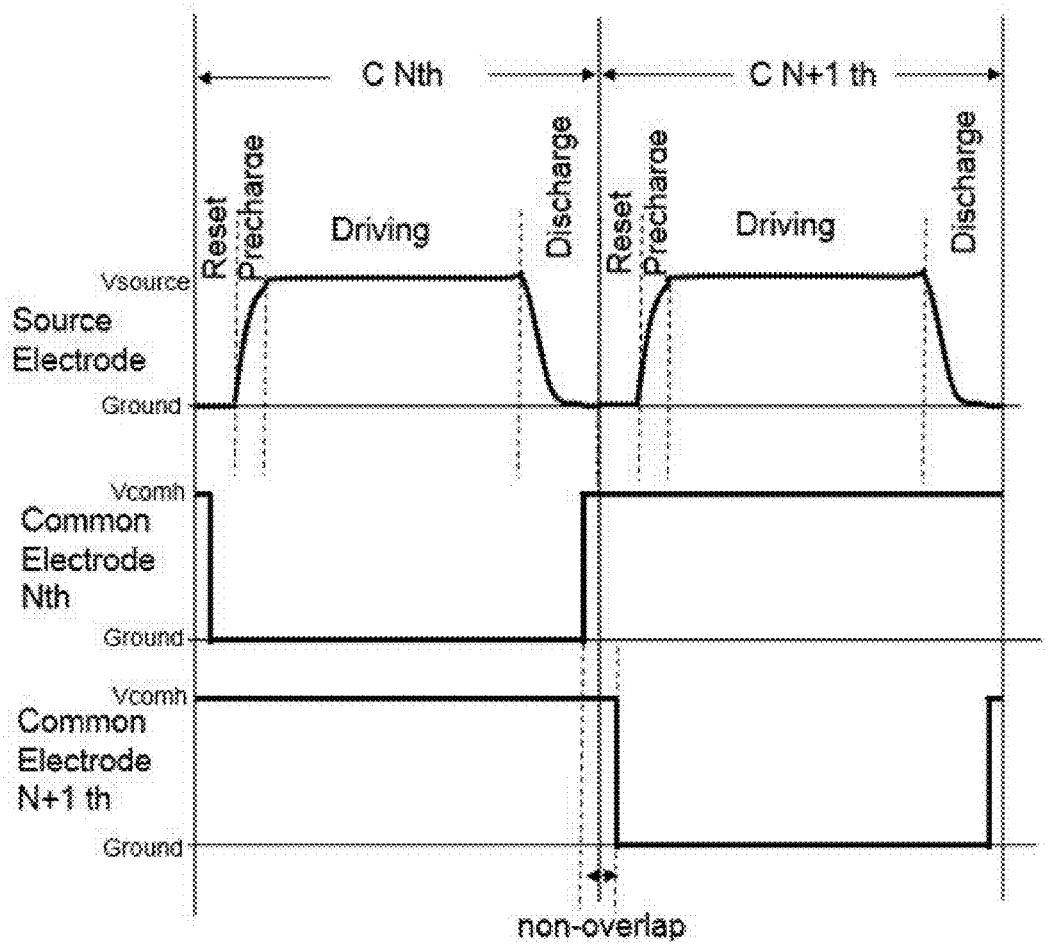
FIG. 4 illustrates a waveform for source and common electrodes, in accordance with an embodiment of the present application.

Referring to FIG. 4, a waveform for source and common electrode is illustrated, in accordance with an embodiment of the present application. During scanning a Nth common electrode, the Nth common electrode is connected to ground. Other common electrodes stay at common high voltage node (Vcomh). During common electrode non-overlap period, all the common electrodes stay at Vcomh. For source electrode, it has reset, pre-charge, driving and discharge phase.

Figure 5:
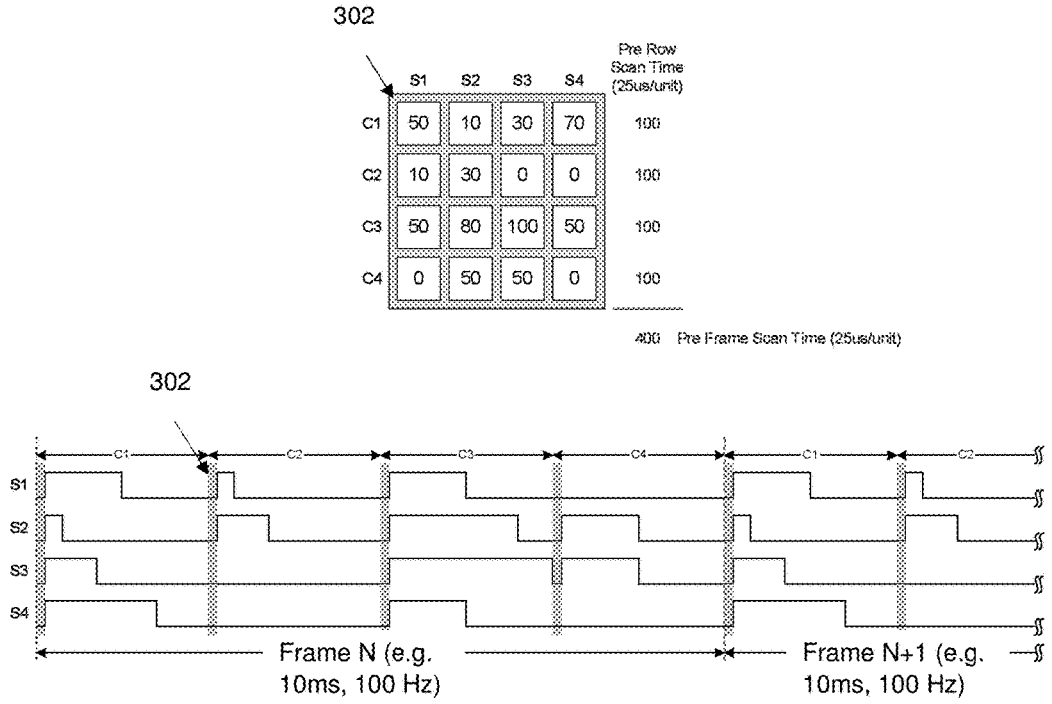
FIG. 5 (Prior Art)
FIG. 5 illustrates an exemplary 4-by-4 PMOLED panel and the corresponding waveforms using conventional display driving scheme.

Referring to FIG. 5, an exemplary 4-by-4 PMOLED panel and the corresponding waveforms using conventional display driving scheme is illustrated. In one embodiment, the numerical value corresponding to each pixel 301 may indicate the intended brightness for the corresponding pixel 301. It must be noted that, only source electrode's driving period is considered for brightness contribution. The conventional PMOLED display driving scheme (as shown in FIG. 5) may scan each horizontal row in succession. That is, all source drivers drive the PMOLED panel concurrently while only one common electrode switch is selected at any time. The common electrode selected may be shorted to ground while the other common electrodes may be disconnected from the ground. This process may be repeated row after row until all rows are scanned. During the transition period 302, all the source drivers may remain off so as to ensure no leakage of current.

In one embodiment, as shown in FIG. 5, the first row to scan is 'C1' which is followed by 'C2', 'C3' and 'C4'. This may complete one frame 201 (or one cycle) of scanning. If the PMOLED display is refreshed at 100 Hz then each frame 201 scan may be completed in 10 ms (or each row scan shares 2.5 ms). As described above, the brightness index with maximum value (i.e. 100) indicates the full brightness. Hence, 1 unit of brightness index may take up 2.5 ms/100=25 us. A column of number next to the PMOLED panel indicates the time taken to scan each row. 100 units of time per row or 400 units of time per frame. Therefore, each unit of time is 25 us.

Figure 6:
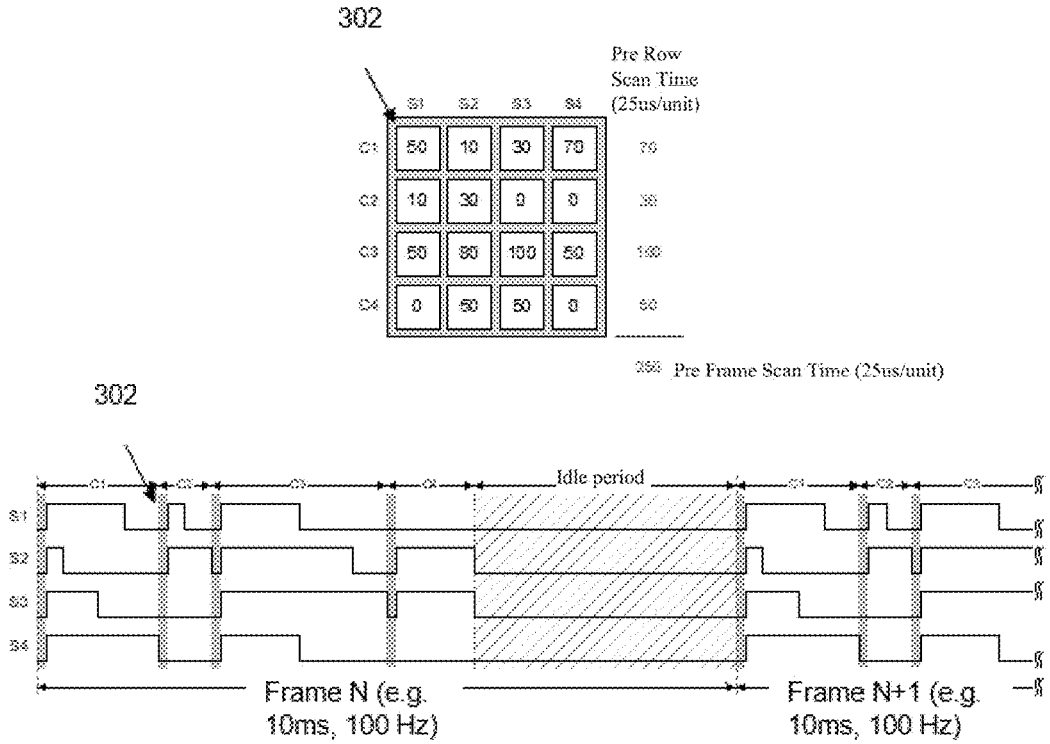
FIG. 6 illustrates a compressed frame scan scheme, in accordance with an embodiment of the present application.

FIG. 6 illustrates a compressed frame scan scheme, in accordance with an embodiment of the present application. For each row of pixels 301, the max finder 103 may identify the pixel 301 of maximum brightness index. In one example, as shown in FIG. 6, for the first row, the second row, the third row and the fourth row, the pixel 301 of maximum brightness is 70, 30, 100 and 50 respectively. The scan control logic 106 may assign the maximum pixel data identified in the row as a pixel data for the row. Further, the scan control logic 106 may compute a scan time for the row based upon the pixel data of the row and a scanning time associated with a unit of the brightness index as below Time for scanning the first row=70*25 us=1.75 ms Time for scanning the second row=30*25 us=0.75 ms Time for scanning the third row=100*25 us=2.5 ms Time for scanning the fourth row=50*25 us=1.25 ms In one embodiment, the scan control logic 106 may further determine an aggregate scan time for the frame 201 based upon the scan time computed for each of the plurality of rows corresponding to the frame 201 as below:

The aggregate time to scan a complete frame 201=Summation of scanning time of each row The aggregate time to scan a complete frame 201=1.75 ms+0.75 ms+2.5 ms+1.25 ms The aggregate time to scan a complete frame 201=6.25 ms (which is less than 10 ms for 100 Hz refresh rate)

Idle period may be calculated as 10 ms−6.25 ms=3.75 ms

Therefore, in order to maintain the same brightness and refresh rate, idle period of 3.75 ms may be inserted/appended before starting a new frame scan. It must be noted herein that the transition periods 302 (in the order of microseconds) are not considered in the above calculation for conciseness. However, since these transition periods 302 are in the order of microseconds), therefore, excluding these from the above calculations does not affect the overall scanning logic. The scan control logic 106 may scan the frame 201 based upon the aggregate scan time determined for the frame 201 thereby enabling compressed scanning of the frame 201.

Figure 7:
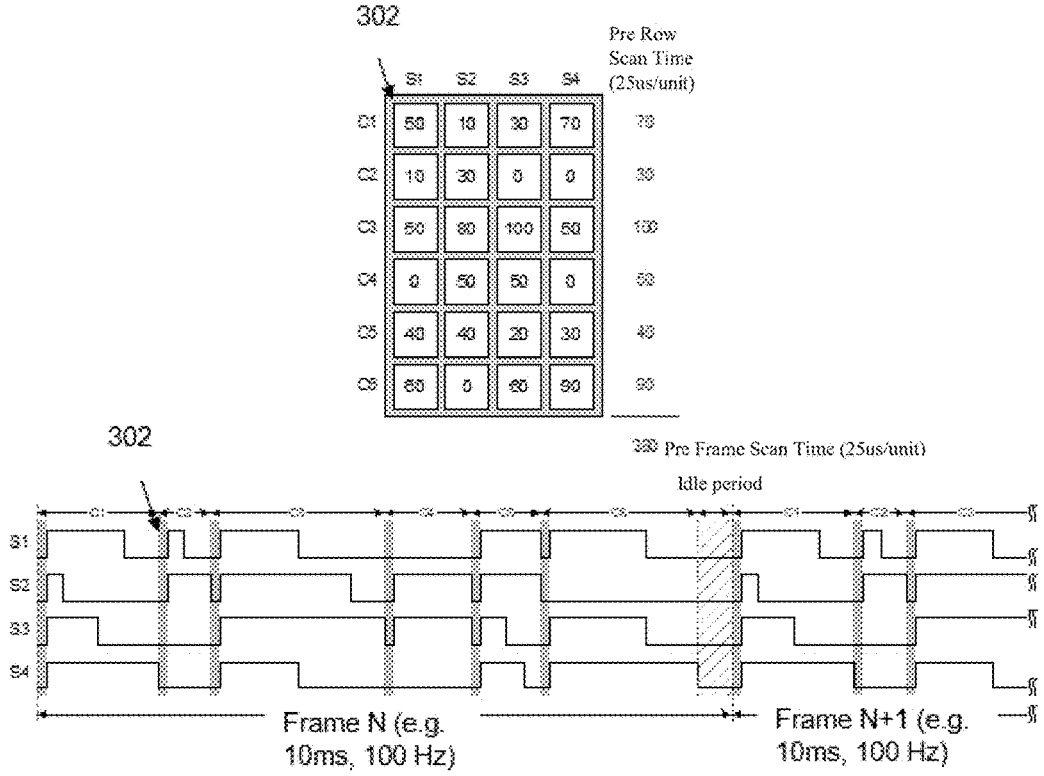
FIG. 7 illustrates an application of the compressed frame scan scheme, in accordance with an embodiment of the present application.

Referring to FIG. 7 is an application of compressed frame scan scheme, in accordance with an embodiment of the present application. In this embodiment, the number of rows is more as compared to those considered in FIG. 6 described above. Since, not all pixels 301 are with maximum brightness, scan time compression may be possible. For this case:

Time for scanning a first row=70*25 us=1.75 ms

Time for scanning a second row=30*25 us=0.75 ms

Time for scanning a third row=100*25 us=2.5 ms

Time for scanning a fourth row=50*25 us=1.25 ms

Time for scanning a fifth row=40*25 us=1 ms

Time for scanning a sixth row=90*25 us=2.25 ms

Therefore, aggregate time to scan a complete frame 201=1.75 ms+0.75 ms+2.5 ms+1.25 ms+1 ms+2.25 ms=9.5 ms (which is less than 10 ms for 100 Hz refresh rate)

Idle period may be calculated as: 10 ms−9.5 ms=0.5 ms

Therefore, in order to maintain the same brightness and refresh rate and to complete 10 ms frame scanning cycle, idle period of 0.5 ms may be inserted/appended before starting a new frame scan.

Figure 8:
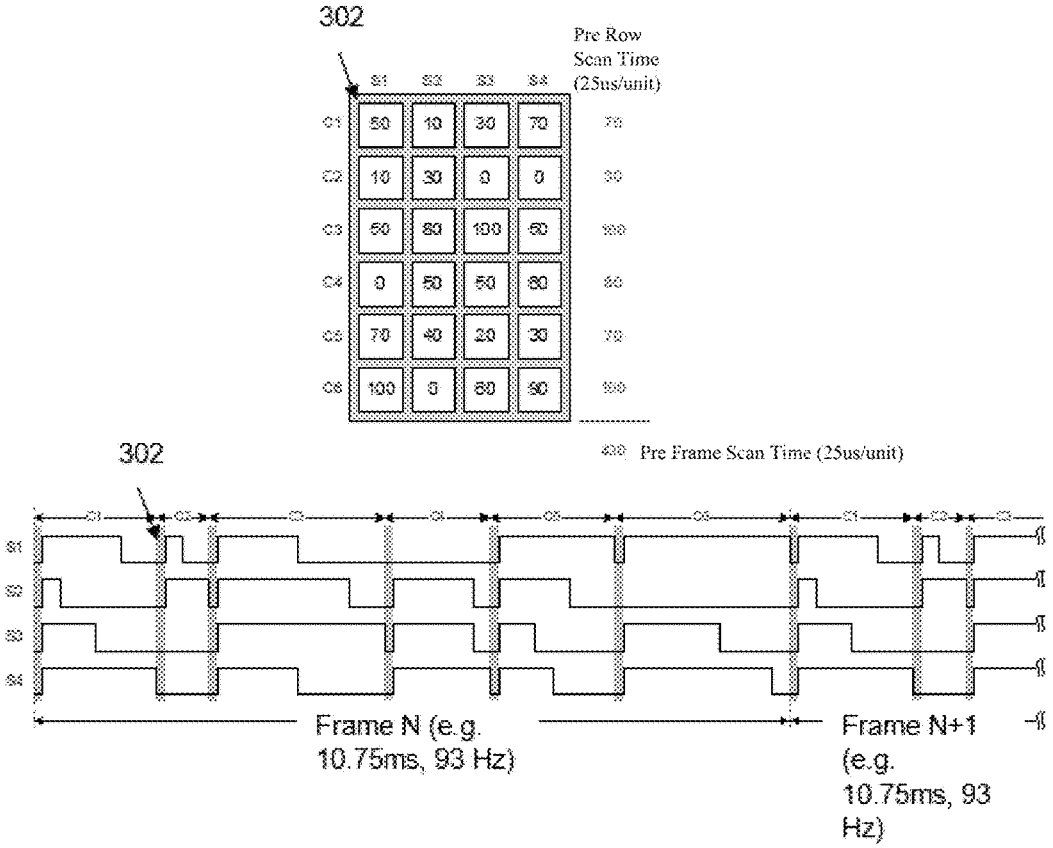
FIG. 8 illustrates another application of the compressed frame scan scheme, in accordance with an embodiment of the present application.

FIG. 8 illustrates another application of the compressed frame scan scheme, in accordance with an embodiment of the present application. In this embodiment, the number of rows is same as those shown in FIG. 7 described above, however, the brightness index of the pixel 301 is more as compared to those shown in FIG. 7. For this case:

Time for scanning a first row=70*25 us=1.75 ms

Time for scanning a second row=30*25 us=0.75 ms

Time for scanning a third row=100*25 us=2.5 ms

Time for scanning a fourth row=60*25 us=1.5 ms

Time for scanning a fifth row=70*25 us=1.75 ms

Time for scanning a sixth row=100*25 us=2.5 ms

Therefore, aggregate time to scan a complete frame 201=1.75 ms+0.75 ms+2.5 ms+1.5 ms+1.75 ms+2.5 ms=10.75 ms (which is greater than 10 ms for 100 Hz refresh rate).

In the above-mentioned scenario (depicted in FIG. 8), the display may not maintain 100 Hz refresh rate and the display may have to operate at 93 Hz. This slower refresh rate may affect the overall brightness of the display. Further, if the refresh rate is reduced to lesser value (e.g. 70 Hz), the display may not only have a lower overall brightness but also starts to have visual flickering. In order to overcome this issue, an alternative method of compressed frame scanning for a display is proposed as below.

In one embodiment, referring to FIG. 1, the interface logic 101 may store the pixel data and a pixel address into the frame memory 102. The interface logic 101 may further send the pixel data to the max finder 103. Further, the max finder 103 may identify a pixel 301 having a maximum pixel data in a row of the plurality of rows corresponding to the frame. The max finder 103 may register the maximum pixel data into the max register array 104 and reset itself to zero. The frame memory 102 may send the plurality of pixel data or multiple pixel data to the scan control logic 106. The scan control logic 106 may further send the row number to the frame memory 102 and to the max register array 104. At the start of each row, the interface logic 101 may send a control signal to the max finder 103. Further, the max register array 104 may send the maximum value to the scan control logic 106. The frame analyzing module 105 may divide the frame 201 into a first sub-frame 201-A and a second sub-frame 201-B and randomly assign a first set of rows of the plurality of rows and a second set of rows to the first sub-frame 201-A and the second sub-frame 201-B respectively. The frame analyzing module 105 may further send a data related to the first sub-frame 201-A and the second sub-frame 201-B to the scan control logic 106. The scan control logic 106 may assign the maximum pixel data identified in the row of the first set of rows and the row of the second set of rows as a pixel data for the row of the first set of rows and the row of the second set of rows respectively. Further the scan control logic 106 may compute a scan time for the row of the first set of rows based upon the pixel data of the row of the first set of rows and a scanning time associated with a unit of the brightness index. The scan control logic 106 may further compute a scan time for the row of the second set of rows based upon the pixel data of the row of the second set of rows and the scanning time associated with a unit of the brightness index. The scan control logic 106 may determine the aggregate scan time for the first sub-frame 201-A and the second sub-frame 201-B based upon the scan time computed for each row of the first set of rows and each row of the second set of rows respectively. Further, the scan control logic 106 may scan the frame 201 based upon the aggregate scan time determined for the first sub-frame 201-A and the second sub-frame 201-B, thereby enabling compressed scanning of the frame 201.

In one embodiment, the first set of rows and the second set of rows are odd number of rows and even number of rows, respectively, of the plurality of rows or vice-versa. In an alternative embodiment, the first set of rows and the second set of rows may be randomly selected such that the standard scanning time allocated to the frame 201 is equally distributed between the first sub-frame 201-A and the second sub-frame 201-B.

Figure 9:
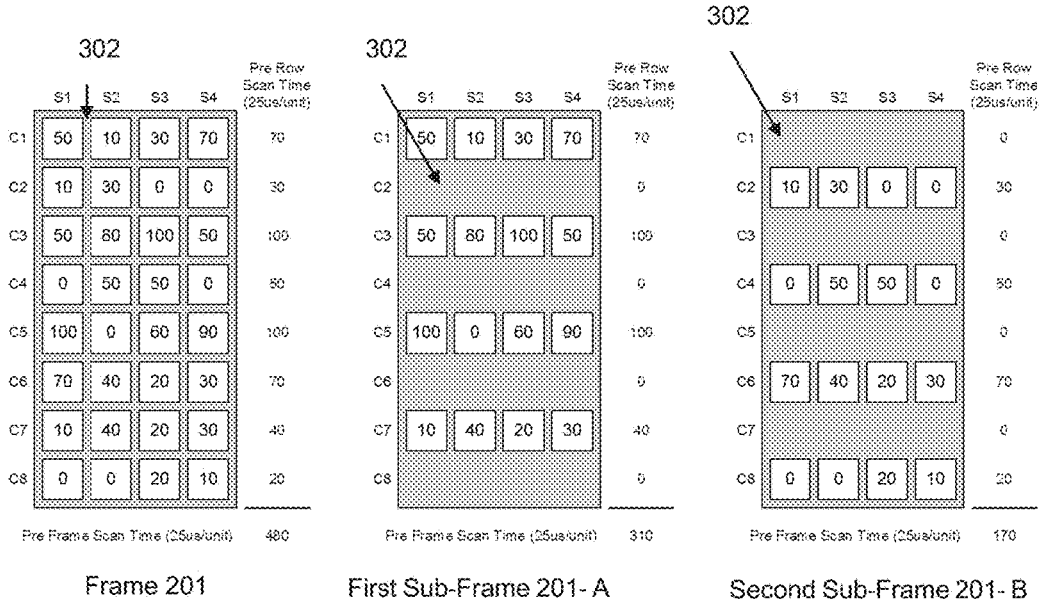
FIG. 9 illustrates a frame scan in simple interlaced mode, in accordance with an embodiment of the present application.

Referring to FIG. 9, a frame scan in simple interlaced mode is illustrated, in accordance with an embodiment of the present application. In this embodiment, the frame 201 may be divided into two sub-frames i.e. the first sub-frame 201-A and the second sub-frame 201-B. The first sub-frame 201-A may be allocated with all odd numbered rows and the second sub-frame 201-B may be allocated with all the even numbered rows for scanning the entire frame 201. These two sub-frames 201-A and 201-B may then be scanned alternately. The refresh rate at which these two frames 201-A and 201-B may produce is twice the original frame rate of the frame 201 thereby reducing the visual perceptual flickering. In one example, as shown in FIG. 9, the first sub-frame 201-A may take 310 units of time while the second sub-frame 201-B may take 170 units of time to complete the scan which may further reduce effectiveness of scanning the frame with the simple interlaced mode. Therefore, a more robust, effective and efficient balanced interlaced mode based scanning of a frame is proposed herein which is explained in detail hereinafter as below.

Figure 10:
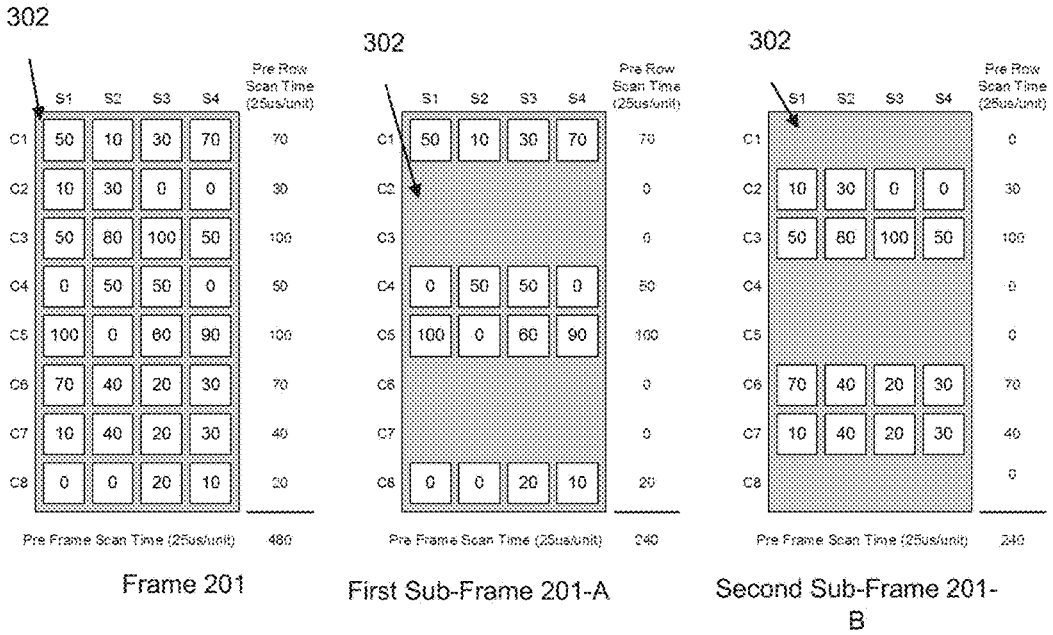
FIG. 10 illustrates a frame scan in balanced interlaced mode, in accordance with an embodiment of the present application.

Referring to FIG. 10 is a frame scan in balanced interlaced mode, in accordance with an embodiment of the present application. In this embodiment, the first set of rows and the second set of rows may be randomly selected such that the standard scanning time allocated to the frame 201 is equally distributed between the first sub-frame 201-A and the second sub-frame 201-B. In this embodiment, the first sub-frame 201-A may be allocated with row numbers 1, 4, 5 and 8 while the second sub-frame 201-B may be allocated with row numbers 2, 3, 6 and 7. The time taken to scan the first sub-frame 201-A and the second sub-frame 201-B is same i.e. 240 units (or 240*25 us=6 ms). The refresh rate of the first sub-frame 201-A and the second sub-frame 201-B is ⅙ ms i.e. 167 Hz.

Figure 11:
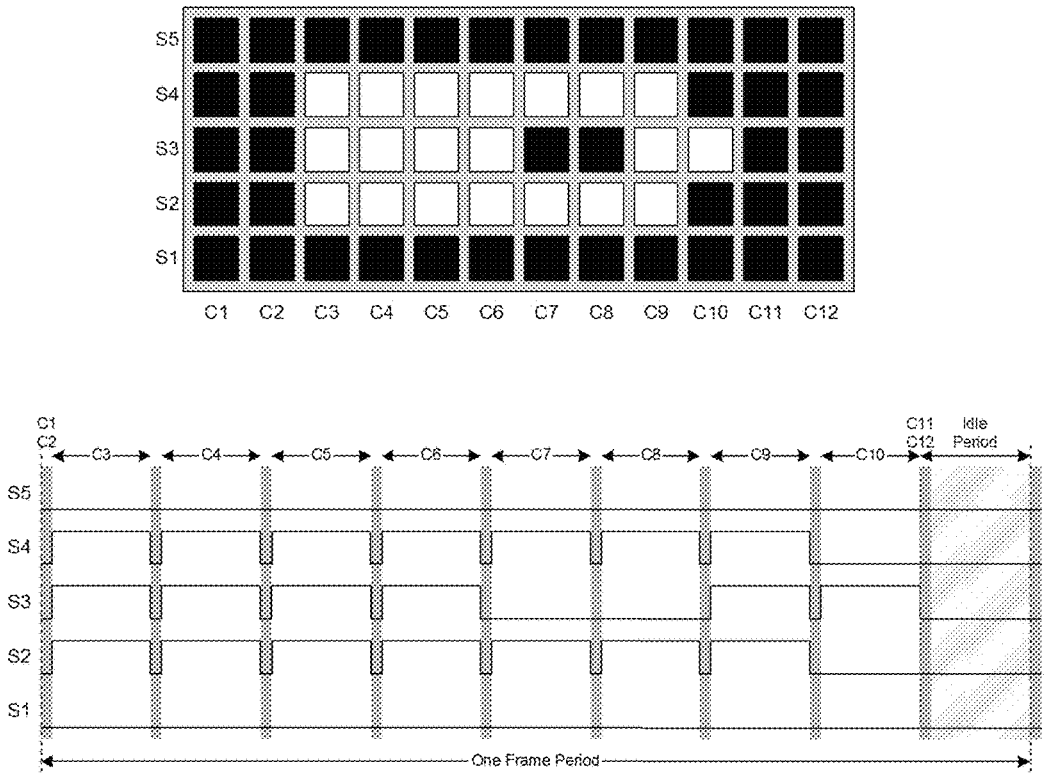
FIG. 11 illustrates the compressed frame scan scheme used in bi-level display, in accordance with an embodiment of the present application.

FIG. 11 illustrates the compressed frame scan scheme used in bi-level display, in accordance with an embodiment of the present application. In one embodiment, the bi-level display may be a black and white display. In another embodiment, a PMOLED display can be overlay by a RGB (Red, Green, Blue) color filter film (the same method used in color LCD display). Hence, the display may present red, green, blue and dark on its pixels forming an eight-color display (red, yellow, green, cyan, blue, violet, white and black). In one embodiment, the display may be rotated by 90 degrees so that the common electrodes become column electrodes and the source electrodes become row electrodes. It must be noted herein that the 1st column, 2nd column, 11th column and 12th column have no bright pixels. Hence, in the timing diagram, besides the transition periods 302, the scan times for 1st column, 2nd column, 11th column and 12th column may be compressed to zero. Similar to gray scale display cases, if the aggregate scan time for all scan lines are less that the aggregate scanning period then the idle period may be appended at the end.

Figure 12:
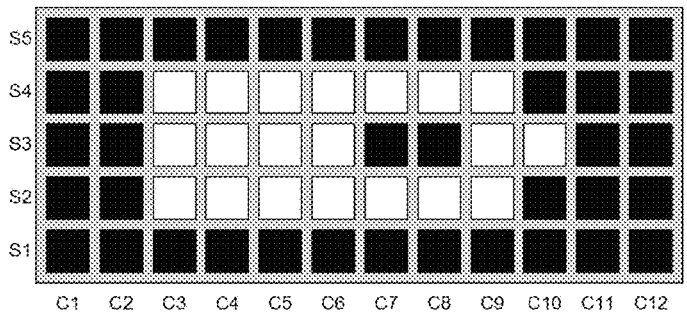
FIG. 12 illustrates alternate scanning approach used in bi-level display, in accordance with an embodiment of the present application.
Figure 12:
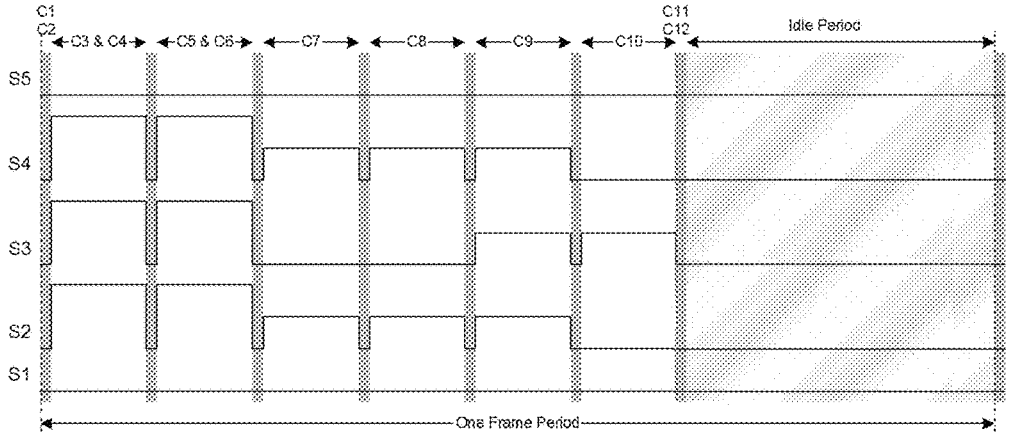

FIG. 12 illustrates alternate scanning approach used in bi-level display, in accordance with an embodiment of the present application. In this embodiment, the source electrodes driving waveforms for time periods $3^{rd}$ column, $4^{th}$ column, $5^{th}$ column and $6^{th}$ column are the same. Hence, it may be possible to combine the common electrodes for driving. The source driver output currents may increase accordingly. The scanning of $3^{rd}$ column and $4^{th}$ column may be combined and the scanning of $5^{th}$ column and $6^{th}$ column may be combined. The corresponding source driver output currents may be doubled. By doing so, the total time to scan one frame 201 may further be compressed.

Figure 13:
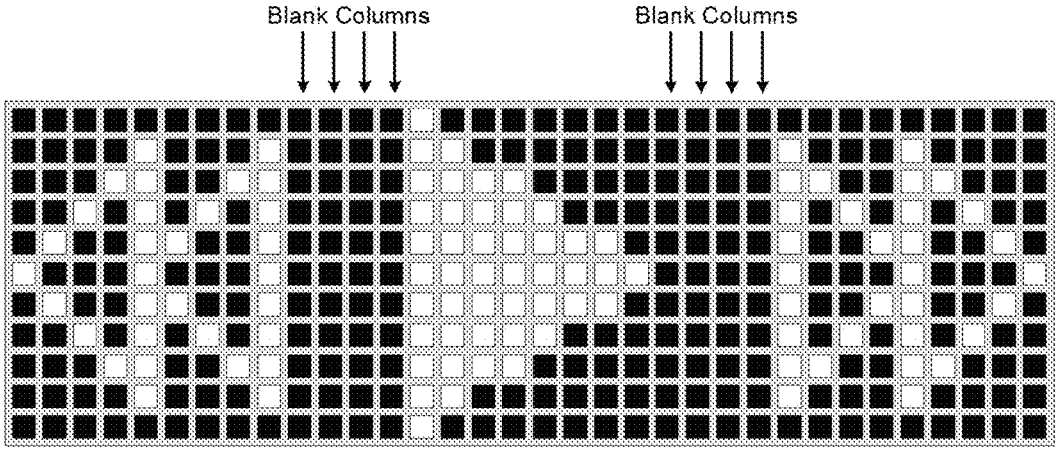
FIG. 13 illustrates designing a user interface, in accordance with an embodiment of the present application.

Referring to FIG. 13, illustrates designing a user interface, in accordance with an embodiment of the present application. More particularly, a user interface for music control system is shown. There are three control symbols on it and there are blank columns between the symbols. This exemplary display has 34 columns while 8 columns are blank. Thus, effectively, only 26 columns need display driving or around ¾ of the total column number. Here, advantage of compressed frame scan scheme may be taken. The overall effect may be slightly dimmer. In most cases, this is acceptable.

Figure 14:
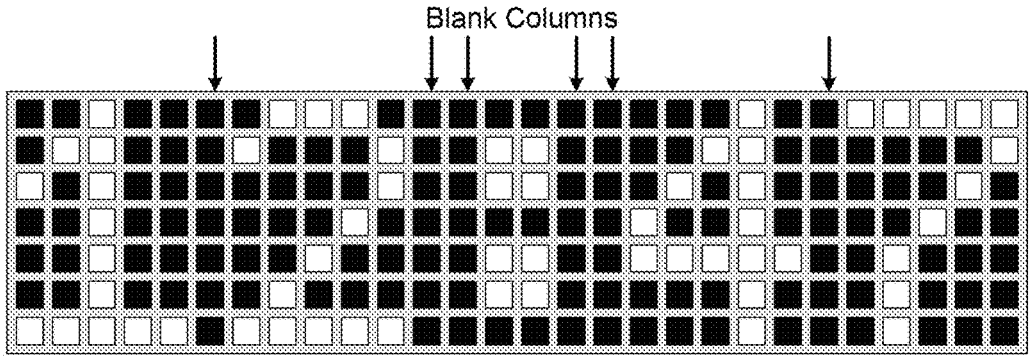
FIG. 14 illustrates a digital watch user interface with dots, in accordance with an embodiment of the present application.
Figure 15:
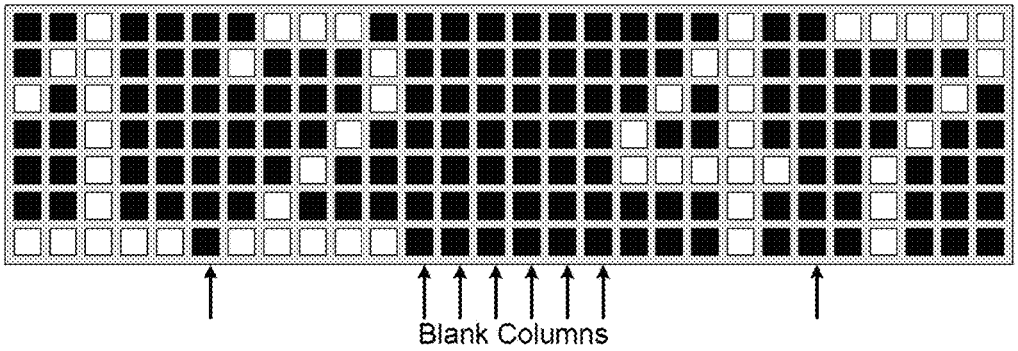
FIG. 15 illustrates a digital watch user interface without dots, in accordance with an embodiment of the present application.

Referring to FIG. 14 and FIG. 15, a digital watch user interface with dots and without dots is illustrated respectively, in accordance with an embodiment of the present application. In this embodiment, the hours and the minutes are displayed but not the seconds. The two dots at the middle flash every second so as to indicate the digital watch is still working. For this user interface, all the digits must have equal brightness irrespective of whether the dots are displayed. In this embodiment, the PMOLED display (shown in FIGS. 14 and 15) has 28 columns. Assuming that the display driver for this panel may support 20 columns to full brightness when operating at 100 Hz. For FIG. 14, 22 columns may need driving so the digits will be slightly dimmer than full brightness and only 20 columns may need driving for FIG. 15 so the digits can unveil full brightness. In such case, brightness may change frequently. Therefore, the bright level of this bi-level display may be preset to 90% of full brightness. The compressed frame scan scheme may then reduce the scan time for each column by 10%. For FIG. 14, this may allow 22 columns to be scanned within one frame scan period (e.g. 10 ms for 100 Hz). For FIG. 15, an idle period may be appended after complete scanning of the 20 columns. In doing so, all digits can have the same brightness regardless of the dots are displayed or not.

Figure 16:
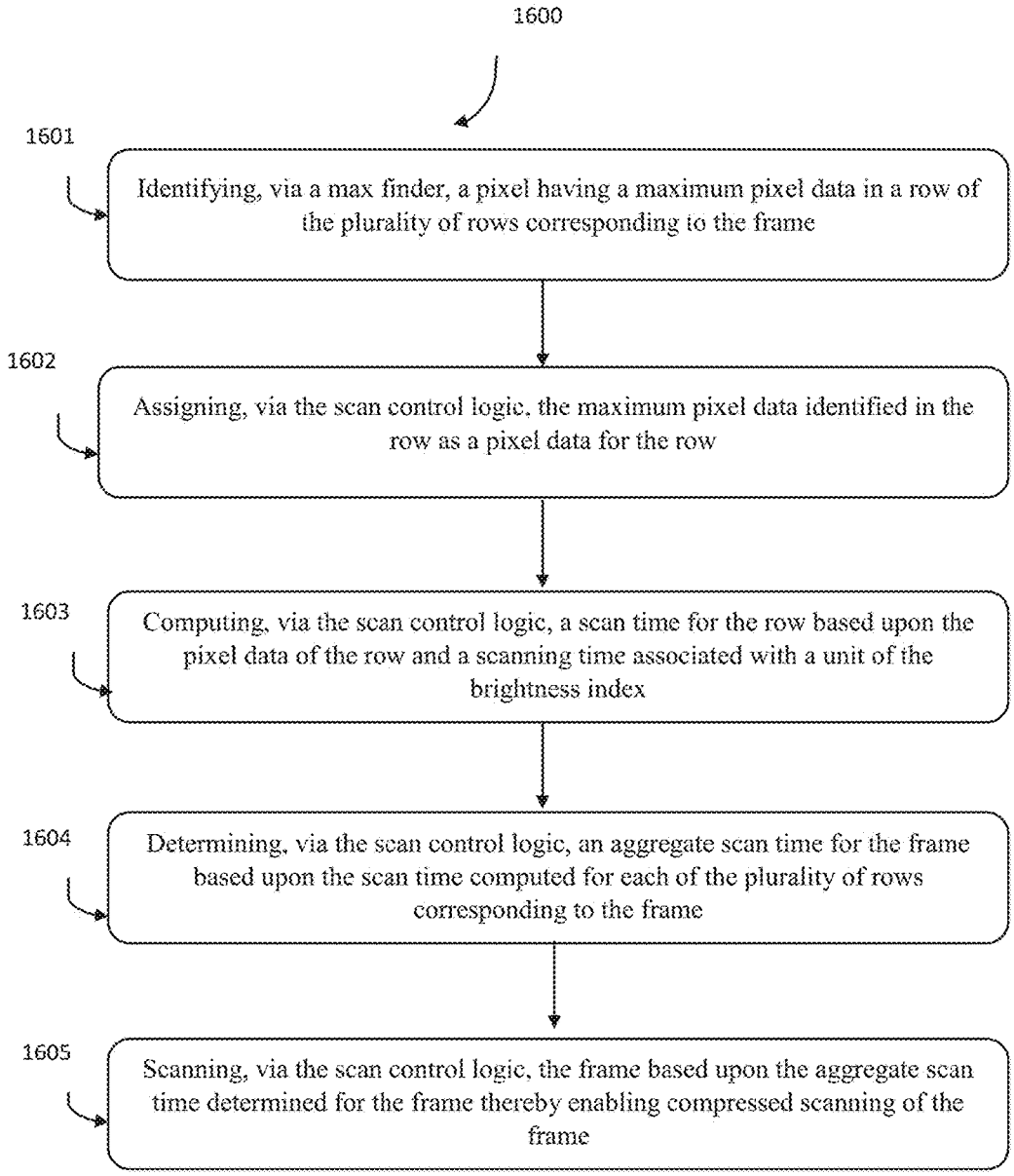
FIG. 16 illustrates method enabling a compressed frame scanning for a display, in accordance with an embodiment of the present application.

Now referring to FIG. 16, a method 1600 enabling compressed frame scanning for a display is illustrated, in accordance with an embodiment of the present application. The method 1600 may be implemented for a display panel comprising a plurality of common electrodes and a plurality of source electrodes arranged in form of a plurality of rows and a plurality of columns, respectively, corresponding to a frame, wherein an intersection of a row and a column, in the display panel, represents a pixel of a plurality of pixels associated to the display panel, and wherein each pixel is assigned with a predefined pixel data indicating a brightness index associated with each pixel.

As shown in FIG. 16, at step 1601, a pixel 301 having a maximum pixel data in a row of the plurality of rows corresponding to the frame 201 may be identified. In one implementation, the pixel 301 having maximum pixel data may be identified by the max finder 103.

At step 1602, the maximum pixel data identified in the row may be assigned as a pixel data for the row. In one implementation, the maximum pixel data may be assigned as a pixel data for the row by the scan control logic 106.

At step 1603, a scan time for the row may be computed based upon the pixel data of the row and a scanning time associated with a unit of the brightness index. In one implementation, the scan time for the row may be computed by the scan control logic 106.

At step 1604, an aggregate scan time for the frame 201 may be determined based upon the scan time computed for each of the plurality of rows corresponding to the frame 201.

In one implementation, the aggregate scan time for the frame 201 may be determined by the scan control logic 106.

At step 1605, the frame 201 may be scanned based upon the aggregate scan time determined for the frame 201 thereby enabling compressed scanning of the frame 201. In one implementation, the frame 201 may be scanned by the scan control logic 106.

Figure 17:
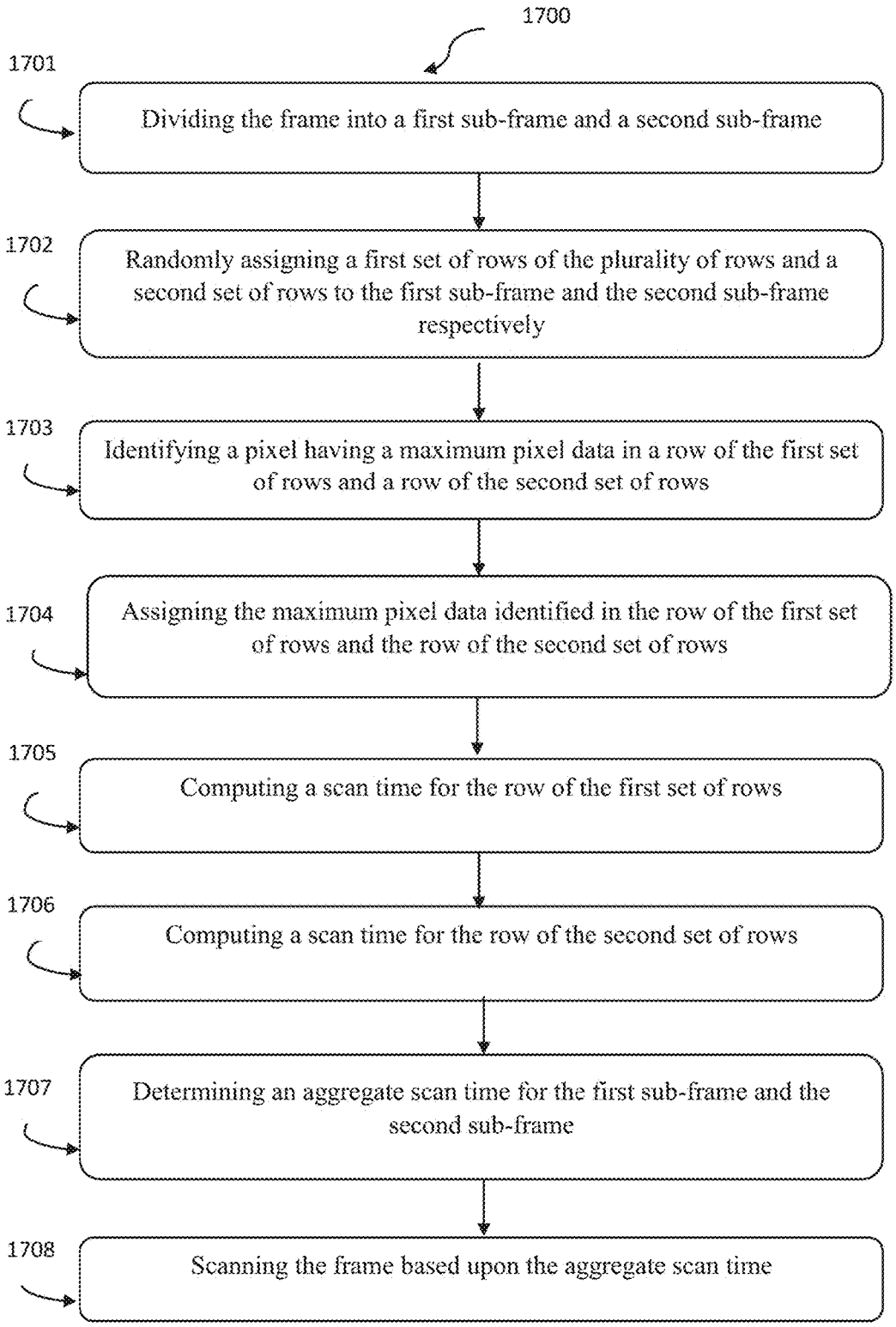
FIG. 17 illustrates alternate method of compressed frame scanning for a display, in accordance with an embodiment of the present application.

Now referring to FIG. 17, a method 1700 enabling compressed frame scanning for a display is illustrated, in accordance with an embodiment of the present application. The method 1700 may be implemented for a display panel comprising a plurality of common electrodes and a plurality of source electrodes arranged in form of a plurality of rows and a plurality of columns, respectively, corresponding to a frame, wherein an intersection of a row and a column, in the display panel, represents a pixel of a plurality of pixels associated to the display panel, and wherein each pixel is assigned with a predefined pixel data indicating a brightness index associated with each pixel.

At step 1701, the frame 201 may be divided into a first sub-frame 201-A and a second sub-frame 201-B. In one implementation, the frame 201 may be divided by the frame analyzing module 105.

At step 1702, a first set of rows of the plurality of rows and a second set of rows of the plurality of rows may be randomly assigned to the first sub-frame 201-A and the second sub-frame 201-B respectively. In one implementation, the first set of rows and the second set of rows may be randomly assigned by the frame analyzing module 105.

At step 1703, a pixel 301 having a maximum pixel data in a row of the first set of rows and a row of the second set of rows may be identified. In one implementation, the pixel 301 having maximum pixel data in a row of the first set of rows and a row of the second set of rows may be identified by the max finder 103.

At step 1704, the maximum pixel data identified in the row of the first set of rows and the row of the second set of rows may be assigned as a pixel data for the row of the first set of rows and the row of the second set of rows respectively. In one implementation, the pixel data for the row of the first set of rows and the row of the second set of rows may be assigned by the scan control logic 106.

At step 1705, a scan time for the row of the first set of rows may be computed based upon the pixel data of the row of the first set of rows and a scanning time associated with a unit of the brightness index. In one implementation, the scan time for the row of the first set of rows may be computed by the scan control logic 106.

At step 1706, a scan time for the row of the second set of rows may be computed based upon the pixel data of the row of the second set of rows and a scanning time associated with a unit of the brightness index. In one implementation, the scan time for the row of the second set of rows may be computed by the scan control logic 106.

At step 1707, an aggregate scan time for the first sub-frame 201-A and the second sub-frame 201-B may be determined based upon the scan time computed for each row of the first set of rows and each row of the second set of rows respectively. In one implementation, the aggregate scan time for the first sub-frame 201-A and the second sub-frame 201-B may be determined by the scan control logic 106.

At step 1708, the frame 201 may be scanned based upon the aggregate scan time determined for the first sub-frame 201-A and the second sub-frame 201-B thereby enabling compressed scanning of the frame 201. In one implementation, the frame may be scanned by the scan control logic 106.

Although implementations for system of compressed frame scanning for a display and a method thereof have been described in language specific to structural features and/or methods, it is to be understood that the appended claims are not necessarily limited to the specific features or methods described. Rather, the specific features and methods are disclosed as examples of implementations for system of compressed frame scanning for a display and a method thereof.

The embodiments, examples and alternatives of the preceding paragraphs or the description and drawings, including any of their various aspects or respective individual features, may be taken independently or in any combination. Features described in connection with one embodiment are applicable to all embodiments, unless such features are incompatible.

What is claimed is:

1. A system enabling compressed frame scanning for a display, the system comprising:

a display panel comprising a plurality of common electrodes and a plurality of source electrodes arranged in form of a plurality of rows and a plurality of columns, respectively, corresponding to a frame, wherein an intersection of a row and a column, in the display panel, represents a pixel of a plurality of pixels associated to the display panel, and wherein each pixel is assigned with a predefined pixel data indicating a brightness index associated with each pixel;

and a processor adapted to:

identify a pixel having a maximum pixel data in a row of the plurality of rows corresponding to the frame; and scan each of the plurality of rows corresponding to the frame, wherein the scanning comprises assigning the maximum pixel data identified in the row as a pixel data for the row;

computing a scan time for the row based upon the pixel data of the row and a scanning time associated with a unit of the brightness index;

determining an aggregate scan time for the frame based upon the scan time computed for each of the plurality of rows corresponding to the frame; and scanning the frame based upon the aggregate scan time determined for the frame thereby enabling compressed scanning of the frame.

2. The system of claim 1, wherein the brightness index is within a range of 0-100 having a minimum brightness index value and a maximum brightness index value of '0' and '100' respectively, and wherein the minimum brightness index value and the maximum brightness index value, respectively, indicates full darkness and full brightness in the display.

3. The system of claim 2, wherein the processor is adapted to connect a common electrode, corresponding to the row, to a ground while disconnecting the other common electrodes corresponding to the other rows of the plurality of rows from the ground.

4. The system of claim 3, wherein the processor is adapted to enable each source electrode corresponding to the frame to output a predefined constant current based upon the pixel data corresponding to each pixel.

5. The system of claim 4, wherein each source electrode is enabled to output the predefined constant current after the expiry of a transition period, and wherein the transition period indicates a time period between the termination of the scanning a row and initiation of the scanning of a subsequent row of the plurality of rows.

6. The system of claim 5, wherein the processor is further adapted to append an idle time period after the scanning of the frame and before the initiation of the scanning of a subsequent frame, wherein the idle period is appended if the aggregate scan time is less than a predefined frame period.

7. The system of claim 6, wherein the scanning time associated with the unit of brightness index is based upon the ratio of a standard scanning time allocated to each row to the maximum brightness index value, and wherein the standard scanning time allocated to each row is based upon a predefined refresh rate associated with the display.

8. The system of claim 7, wherein the processor is further adapted to combine the scanning of two rows of the plurality of rows thereby enabling further compression of the scanning of the frame, and wherein the common electrodes corresponding to the two rows are driven by increasing the current source from the corresponding source electrodes.

9. A method of enabling compressed frame scanning for a display, the method comprising:

providing a display panel comprising a plurality of common electrodes and a plurality of source electrodes arranged in form of a plurality of rows and a plurality of columns, respectively, corresponding to a frame, wherein an intersection of a row and a column, in the display panel, represents a pixel of a plurality of pixels associated to the display panel, and wherein each pixel is assigned with a predefined pixel data indicating a brightness index associated with each pixel;

identifying a pixel having a maximum pixel data in a row of the plurality of rows corresponding to the frame;

assigning the maximum pixel data identified in the row as a pixel data for the row;

computing a scan time for the row based upon the pixel data of the row and a scanning time associated with a unit of the brightness index;

determining an aggregate scan time for the frame based upon the scan time computed for each of the plurality of rows corresponding to the frame; and scanning the frame based upon the aggregate scan time determined for the frame thereby enabling compressed scanning of the frame.

10. A system enabling compressed frame scanning for a display, the system comprising:

a display panel comprising a plurality of common electrodes and a plurality of source electrodes arranged in form of a plurality of rows and a plurality of columns, respectively, corresponding to a frame, wherein an intersection of a row and a column, in the display panel, represents a pixel of a plurality of pixels associated to the display panel, and wherein each pixel is assigned with a predefined pixel data indicating a brightness index associated with each pixel;

and a processor adapted to:

divide the frame into a first sub-frame and a second sub-frame and randomly assign a first set of rows of the plurality of rows and a second set of rows to the first sub-frame and the second sub-frame respectively;

identify a pixel having a maximum pixel data in a row of the first set of rows and a row of the second set of rows; and scan each of the plurality of rows corresponding to the frame, wherein the scanning comprises assigning the maximum pixel data identified in the row of the first set of rows and the row of the second set of rows as a pixel data for the row of the first set of rows and the row of the second set of rows respectively;

computing a scan time for the row of the first set of rows based upon the pixel data of the row of the first set of rows and a scanning time associated with a unit of the brightness index and a scan time for the row of the second set of rows based upon the pixel data of the row of the second set of rows and the scanning time associated with a unit of the brightness index;

determining an aggregate scan time for the first sub-frame and the second sub-frame based upon the scan time computed for each row of the first set of rows and each row of the second set of rows respectively; and scanning the frame based upon the aggregate scan time determined for the first sub-frame and the second sub-frame thereby enabling compressed scanning of the frame.

11. The system of claim 10, wherein the first set of rows and the second set of rows are odd number of rows and even number of rows, respectively, of the plurality of rows or vice-versa.

12. The system of claim 10, wherein the first set of rows and the second set of rows are randomly selected such that the standard scanning time allocated to the frame is equally distributed between the first sub-frame and the second sub-frame.

13. The system of claim 12, wherein the brightness index is within a range of 0-100 having a minimum brightness index value and a maximum brightness index value of '0' and '100' respectively, and wherein the minimum brightness index value and the maximum brightness index value, respectively, indicates full darkness and full brightness in the display.

14. The system of claim 13, wherein the processor is adapted to connect a common electrode, corresponding to the row, to a ground while disconnecting the other common electrodes corresponding to the other rows of the plurality of rows from the ground.

15. The system of claim 14, wherein the processor is adapted to enable each source electrode corresponding to the frame to output a predefined constant current based upon the pixel data corresponding to each pixel.

16. The system of claim 15, wherein each source electrode is enabled to output the predefined constant current after the expiry of a transition period, and wherein the transition period indicates a time period between the termination of the scanning a row and initiation of the scanning of a subsequent row of the plurality of rows.

17. The system of claim 16, wherein the processor is further adapted to append an idle time period after the scanning of the frame and before the initiation of the scanning of a subsequent frame, wherein the idle period is appended if the aggregate scan time is less than a predefined frame period.

18. The system of claim 17, wherein the scanning time associated with the unit of brightness index is based upon the ratio of a standard scanning time allocated to each row to the maximum brightness index value, and wherein the standard scanning time allocated to each row is based upon a refresh rate associated with the display, and wherein the refresh rate is twice of the predefined refresh rate of the frame.

19. The system of claim 18, wherein the processor is further adapted to combine the scanning of two rows of the plurality of rows thereby enabling further compression of the scanning of the frame, and wherein the common electrodes corresponding to the two rows are driven by increasing the current sourced from the corresponding source electrodes.

20. A method of enabling compressed frame scanning for a display, the method comprising:

providing a display panel comprising a plurality of common electrodes and a plurality of source electrodes arranged in form of a plurality of rows and a plurality of columns, respectively, corresponding to a frame, wherein an intersection of a row and a column, in the display panel, represents a pixel of a plurality of pixels associated to the display panel, and wherein each pixel is assigned with a predefined pixel data indicating a brightness index associated with each pixel;

dividing the frame into a first sub-frame and a second sub-frame;

randomly assigning a first set of rows of the plurality of rows and a second set of rows to the first sub-frame and the second sub-frame respectively;

identifying a pixel having a maximum pixel data in a row of the first set of rows and a row of the second set of rows;

assigning the maximum pixel data identified in the row of the first set of rows and the row of the second set of rows as a pixel data for the row of the first set of rows and the row of the second set of rows respectively;

computing via the scan control logic, a scan time for the row of the first set of rows based upon the pixel data of the row of the first set of rows and a scanning time associated with a unit of the brightness index and a scan time for the row of the second set of rows based upon the pixel data of the row of the second set of rows and the scanning time associated with a unit of the brightness index;

determining an aggregate scan time for the first sub-frame and the second sub-frame based upon the scan time computed for each row of the first set of rows and each row of the second set of rows respectively; and scanning the frame based upon the aggregate scan time determined for the first sub-frame and the second sub-frame thereby enabling compressed scanning of the frame.

* * * * *